US011131496B2

(12) United States Patent
Fei et al.

(10) Patent No.: US 11,131,496 B2
(45) Date of Patent: Sep. 28, 2021

(54) REFRIGERATOR

(71) Applicant: QINGDAO HAIER JOINT STOCK CO., LTD, Qingdao (CN)

(72) Inventors: Bin Fei, Qingdao (CN); Xueli Cheng, Qingdao (CN); Xuan Ji, Qingdao (CN); Jinlin Liu, Qingdao (CN)

(73) Assignee: QINGDAO HAIER JOINT STOCK CO., LTD, Qingdao (CN)

( * ) Notice: Subject to any disclaimer, the term of this patent is extended or adjusted under 35 U.S.C. 154(b) by 156 days.

(21) Appl. No.: 15/760,834

(22) PCT Filed: Jun. 8, 2016

(86) PCT No.: PCT/CN2016/085342
§ 371 (c)(1),
(2) Date: Mar. 16, 2018

(87) PCT Pub. No.: WO2017/049961
PCT Pub. Date: Mar. 30, 2017

(65) Prior Publication Data

US 2018/0274840 A1 Sep. 27, 2018

(30) Foreign Application Priority Data

Sep. 24, 2015 (CN) ..... 201510617528.8

(51) Int. Cl.
*F25D 17/04* (2006.01)

(52) U.S. Cl.
CPC ..... *F25D 17/045* (2013.01); *F25D 2317/063* (2013.01); *F25D 2317/0671* (2013.01)

(58) Field of Classification Search
CPC ..... F25D 17/045; F25D 2317/0671; F25D 2317/063; F25D 2317/066; F25D 2317/0661
(Continued)

(56) References Cited

U.S. PATENT DOCUMENTS 5,992,165 A * 11/1999 Kim ..... F25D 17/045 62/187
6,637,225 B1 * 10/2003 Cho ..... F25D 17/045 236/49.3
2007/0137243 A1 6/2007 Lee et al.

FOREIGN PATENT DOCUMENTS

CN 2660431 12/2004
CN 101153761 A 4/2008
(Continued)

OTHER PUBLICATIONS

Office Action for European Patent Application No. 16847843.6 dated Aug. 16, 2018, 6 pages.
(Continued)

*Primary Examiner* — Steven B McAllister
*Assistant Examiner* — Charles R Brawner
(74) *Attorney, Agent, or Firm* — Alston & Bird LLP

(57) ABSTRACT

A refrigerator comprises: a refrigerator compartment comprising a storage compartment and a ventilation channel limited therein, wherein the ventilation channel is configured to provide a cold air to inside of the storage compartment; and a ventilation control device, arranged in the ventilation channel. The ventilation control device comprises: a housing comprising at least one air inlet and a plurality of air outlets; and an adjustment member configured to adjust respective areas of the plurality of air outlets, through which air is output, by being controlled to completely block, partially block, or completely open each of the air outlets, so as to adjust an air volume of the air output to the storage compartment via the ventilation channel.

7 Claims, 3 Drawing Sheets

(58) Field of Classification Search
USPC ..... 454/183
See application file for complete search history.

(56) References Cited

FOREIGN PATENT DOCUMENTS

| | | | | | |
|---|---|---|---|---|---|
| CN | 103471317 | A | | 4/2008 | |
| CN | 201251338 | Y | | 6/2009 | |
| CN | 104089446 | A | | 10/2014 | |
| CN | 104896837 | | | 9/2015 | |
| CN | 205119611 | | | 3/2016 | |
| EP | 2789937 | A1 | | 10/2014 | |
| JP | S572379 | U | | 1/1982 | |
| JP | S59-166074 | U | * | 11/1984 | ..... F16K 11/085 |
| JP | S59166074 | U | | 11/1984 | |
| JP | S62115573 | U | | 7/1987 | |
| JP | 2001280800 | A | | 10/2001 | |
| JP | 2006336946 | | | 12/2006 | |
| KR | 101496679 | B1 | | 3/2015 | |

OTHER PUBLICATIONS

Supplementary European Search Report for Application No. 16847843.6 dated Jul. 24, 2018, 4 pages.
Office Action for Japanese Application 2018-515288 dated Mar. 4, 2019, 6 pages.
International Search Report and Written Opinion of the International Searching Authority for International Patent Application No. PCT/CN2016/085342, dated Sep. 14, 2016, with English translation of Search Report, 10 pages.
Search Report for Chinese Patent Application No. 2015106175288 dated Aug. 15, 2017, 2 pages.
Office Action for Chinese Patent Application No. 201510617528.8 dated Aug. 25, 2017, with English translation, 12 pages.

* cited by examiner

REFRIGERATOR

CROSS-REFERENCE TO RELATED APPLICATIONS

This application is a national phase entry of International Application No. PCT/CN2016/085342, filed Jun. 8, 2016, which claims priority to Chinese Application No. 201510617528.8, filed Sep. 24, 2015, the entire contents of which are incorporated herein by reference.

TECHNICAL FIELD

The present invention relates to freezing and refrigeration devices, and in particular, to a refrigerator.

BACKGROUND OF THE INVENTION

In recent years, with the improvement of people's living standards and improvement of environmental awareness, the requirements for refrigerators have gradually changed from satisfaction with low-temperature refrigeration to the performance of keeping food fresh. In an air supply manner of supplying air to a refrigeration compartment in an existing refrigerator, an air inlet connecting to the refrigeration compartment is usually directly provided on a freezing duct. Further, an air damper may be disposed at the air inlet to adjust the amount of air that enters the refrigeration compartment. Currently, a single air damper or dual air dampers are commonly used. The structure is relatively complex, the costs are relatively high, and the control status is relatively unvaried.

SUMMARY OF THE INVENTION

An objective of the present invention is to provide a novel refrigerator to overcome at least one defect of existing air-cooled refrigerators. In the refrigerator, the amount of air in an air supply duct can be adjusted, to achieve a plurality of states of the air supply duct.

A further objective of the present invention is to provide a refrigerator in which the amount of air in an air supply duct can be simply adjusted and the adjustment precision is high.

A further objective of the present invention is to alleviate the impact of the vibration of an output shaft of a motor on the rotation of an adjustment member and make the adjustment member move stably and turn precisely.

To achieve at least one objective in the foregoing, the present invention provides a refrigerator, comprising:

a refrigerator compartment, a storage compartment and an air supply duct being defined in the refrigerator compartment, and the air supply duct being configured to transfer cold air into the storage compartment; and a branched air supply device, disposed in the air supply duct, and the branched air supply device comprising:

a housing, having at least one air inlet and a plurality of air outlets; and an adjustment member, configured to completely block, partially block or completely expose each air outlet in a controlled manner, to adjust respective air outlet areas of the plurality of air outlets, so as to adjust the amount of air transferred into the storage compartment through the air supply duct.

Optionally, the air supply duct has at least one air supply port, and each air outlet is connected to any one of the at least one air supply port, to enable cold air flowing from the air outlet to enter the storage compartment through each air supply port.

Optionally, the housing comprises a base and a circumferential wall extending from the base to a side of the base, and the plurality of air outlets are formed on the circumferential wall; and the adjustment member comprises one or more blocking portions disposed at an interval in a circumferential direction of the base, and the adjustment member is rotatably mounted on the housing about an axis of the circumferential wall, so that when rotating to different rotational positions, the adjustment member enables the one or more blocking portions to completely block, partially block or completely expose each air outlet.

Optionally, the housing further comprises a distributor cover, covering an end, far away from the base, of the circumferential wall.

Optionally, the plurality of air outlets are grouped into at least two groups, and each group of air outlets has at least one air outlet; the air outlets in each group of air outlets have an equal size; and the size of each air outlet in each group of air outlets is unequal to the size of each air outlet in each of the rest groups of air outlets.

Optionally, the at least one air inlet is further formed on the circumferential wall, and the at least one air inlet is provided between two adjacent air outlets.

Optionally, the adjustment member is further configured to enable, when rotating to a rotational position, the one or more blocking portions to completely block the at least one air inlet, to disconnect the air supply duct.

Optionally, one air inlet is provided;

three air outlets are provided sequentially at an interval in the circumferential direction of the base;

two blocking portions are provided, the two blocking portions are respectively a first blocking portion and a second blocking portion;

the first blocking portion is configured in a way that the first blocking portion is allowed to completely block one air outlet;

the second blocking portion is configured in a way that the second blocking portion is allowed to completely block two air outlets and the second blocking portion is allowed to completely block the air inlet; and an interval between the first blocking portion and the second blocking portion is configured in a way that the interval is allowed to completely expose one air outlet.

Optionally, the adjustment member further comprises a turntable portion disposed coaxially with the circumferential wall, and each blocking portion extends out from one surface from the turntable portion.

Optionally, the branched air supply device further comprises:

a motor, disposed on a radial outer side of the turntable portion;

a gear, mounted on an output shaft of the motor; and a gear ring, comprising an annular convex rib that extends out from the other surface of the turntable portion and is coaxial with the turntable portion and a plurality of gear teeth that extend externally out from an outer circumferential surface of the annular convex rib and are disposed at an interval in a circumferential direction of the annular convex rib, where the gear is engaged with the gear ring, to transfer a rotational movement output by the motor to the adjustment member at a reduced speed.

In the refrigerator of the present invention, a branched air supply device is provided in an air supply duct. Therefore, an adjustment member of the branched air supply device may be used to completely block, partially block or completely expose each air outlet on a housing of the branched air supply device to adjust the amount of air in the air supply duct. The adjustment and control are simple, and a plurality of states of the amount of air in the air supply duct can be achieved.

Further, in the refrigerator of the present invention, the number of opened air outlets may be used to adjust the amount of air in the air supply duct. Therefore, the amount of air can be precisely controlled when the movement is not precise enough. In addition, the sizes of a plurality of air outlets may be unequal to each other, so that different amounts of air can be implemented by opening different air outlets.

Further, in the refrigerator of the present invention, the adjustment member can completely block an air inlet on the housing. Therefore, the air supply duct can be controlled to be opened or closed, so that the branched air supply device with a simple structure can provide the air supply duct with a plurality of states.

Further, in the refrigerator of the present invention, a gear and a gear ring of the branched air supply device can transfer a rotational movement output by a motor to the adjustment member at a reduced speed. Therefore, the impact of the vibration of an output shaft of the motor on the rotation of the adjustment member can be alleviated, and the adjustment member can turn accurately. Therefore, the adjustment member can correctly rotate to a predetermined position to ensure that each air outlet is precisely blocked or exposed. In addition, the gear and the gear ring engaged with each other can further have the effects of reducing a speed and increasing a torque, so that a jamming and stalling phenomenon in the rotation of the motor cam be eliminated.

Further, in the refrigerator of the present invention, the motor of the branched air supply device is disposed on a radial outer side of a turntable portion. Therefore, the overall thickness of the branched air supply device can be reduced. After the branched air supply device is mounted at the rear portion of the refrigerator, the thickness of the refrigerator can be reduced. Therefore, the refrigerator has a small volume or the refrigerator has an increased effective storage space.

According to the detailed description of specific embodiments of the present invention below in conjunction with the accompanying drawings, the above and other objectives, advantages and features will become more apparent to a person skilled in the art.

BRIEF DESCRIPTION OF THE DRAWINGS

Some specific embodiments of the present invention will be described below in detail with reference to the accompanying drawings by way of example but not by way of limitation. The same reference signs indicate the same or similar components or parts in the accompanying drawings. A person skilled in the art should understand that these figures are not necessarily drawn to scale. In the accompanying drawings.

DETAILED DESCRIPTION OF THE INVENTION

Figure 1:
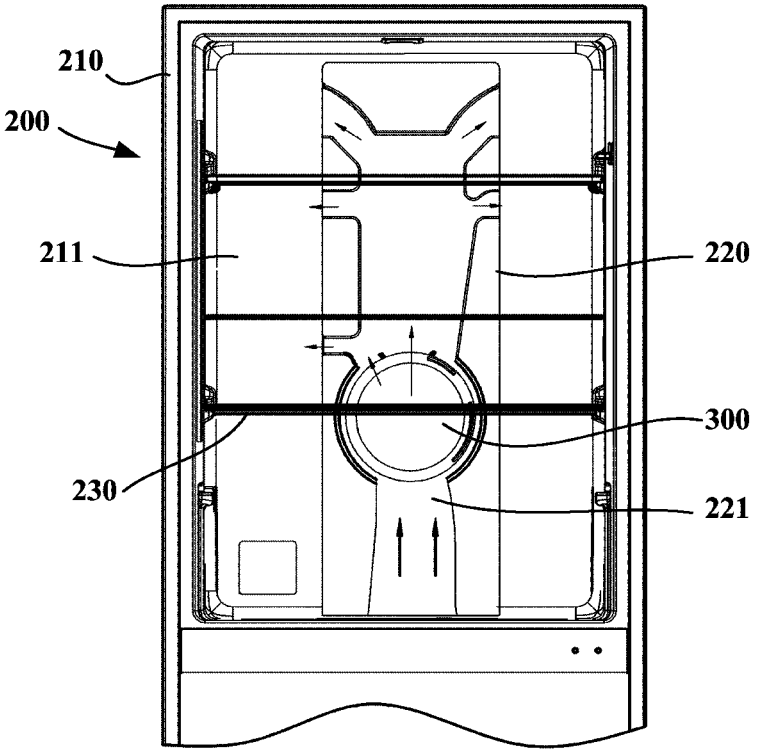
FIG. 1 is a schematic structural diagram of a refrigerator according to an embodiment of the present invention.
Figure 2:
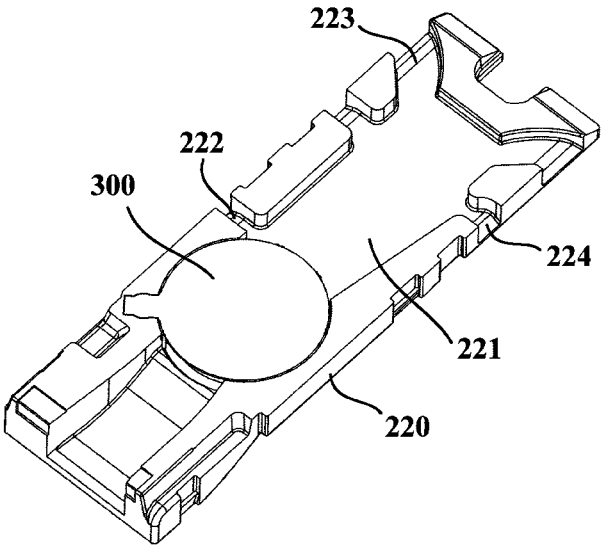
FIG. 2 is a schematic partial structural diagram of a refrigerator according to an embodiment of the present invention.

FIG. 1 is a schematic structural diagram of a refrigerator according to an embodiment of the present invention. As shown in FIG. 1, this embodiment of the present invention provides a refrigerator. The refrigerator may comprise a refrigerator compartment 200. A storage compartment 211 and an air supply duct 221 are defined in the refrigerator compartment 200. The air supply duct 221 may be configured to transfer cold air into the storage compartment 211, to keep the temperature in the storage compartment 211 close to a target temperature. To facilitate the adjustment of cold in the storage compartment 211, the refrigerator in this embodiment of the present invention may further comprise a branched air supply device 300. The branched air supply device 300 may be disposed in the air supply duct 221, to adjust the amount of air in the air supply duct 221, so that the amount of air transferred into the storage compartment 211 through the air supply duct 221 can be adjusted. As shown in FIG. 2, the refrigerator compartment 200 may comprise a liner 210 and a duct cover plate 220. The storage compartment 211 is defined in the liner 210. The duct cover plate 220 is mounted on a rear wall of the liner 210, and the air supply duct 221 for supplying air into the storage compartment 211 is provided on the duct cover plate 220. The branched air supply device 300 is mounted in a duct.

Specifically, the branched air supply device 300 may comprise a housing 40 and an adjustment member 50. The housing 40 may have at least one air inlet 421 and a plurality of air outlets, to enable cold air to enter the housing 40 through the at least one air inlet 421 and flow out from the housing 40 through one or more of the plurality of air outlets. The adjustment member 50 may be configured to completely block, partially block or completely expose each air outlet in a controlled manner, to adjust respective air outlet areas of the plurality of air outlets, so as to adjust the amount of air transferred into the storage compartment 211 through the air supply duct 221. For example, when moving to different positions, the adjustment member 50 can completely block, partially block or completely expose each air outlet. As shown in FIG. 1, the housing 40 has three air outlets. The adjustment member 50 can keep two air outlets in a completely exposed state, and keep the other air outlet in a completely blocked state. In this case, cold air can enter the storage compartment 211 through the two air outlets that are in a completely exposed state. The arrow in FIG. 1 represents the flowing direction of cold air in the air supply duct 221 when the two air outlets of the branched air supply device 300 are both in a completely exposed state.

In this embodiment of the present invention, the air supply duct 221 has at least one air supply port, and each air outlet is connected to any one of the at least one air supply port, to enable cold air flowing from the air outlet to enter the storage compartment 211 through each air supply port.

Figure 3:
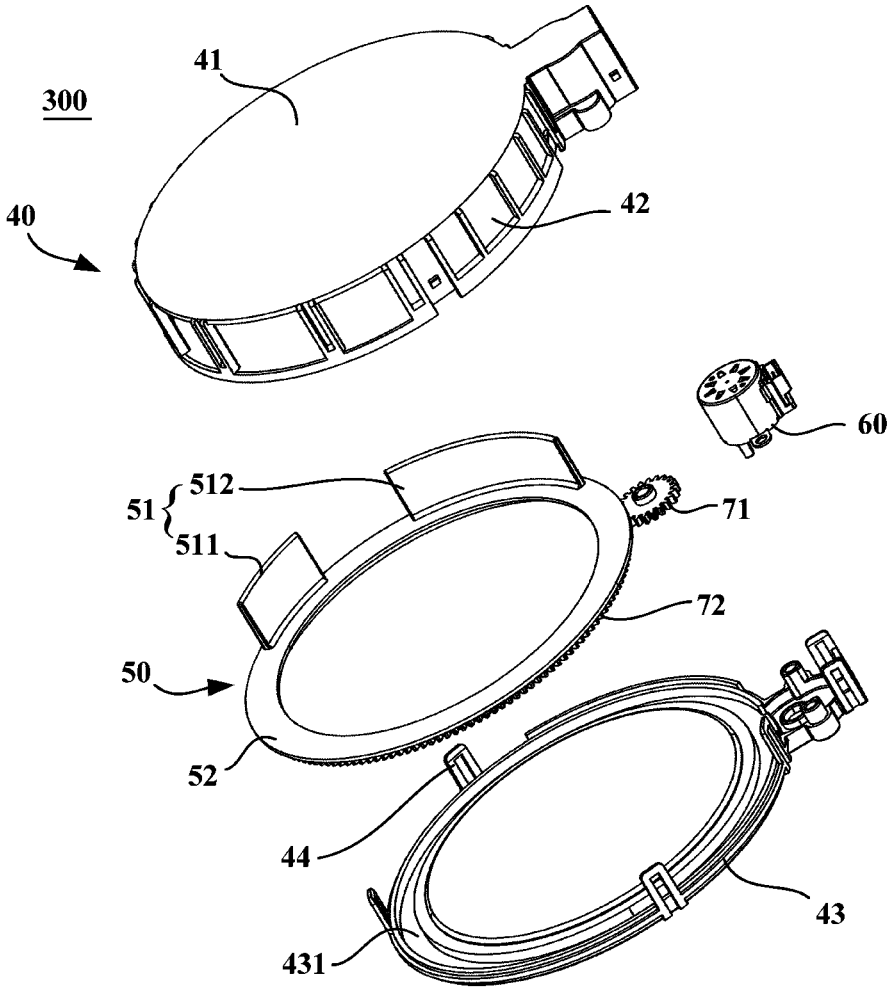
FIG. 3 is a schematic exploded view of a branched air supply device of a refrigerator according to an embodiment of the present invention.
Figure 4:
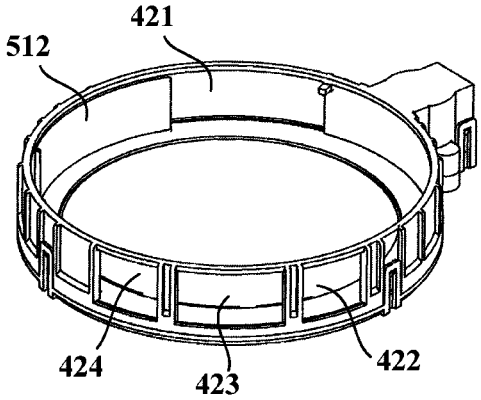
FIGS. 4 to 11 are respectively schematic partial structural diagrams of an adjustment member in a branched air supply device of a refrigerator at different rotational positions according to embodiments of the present invention.
Figure 5:
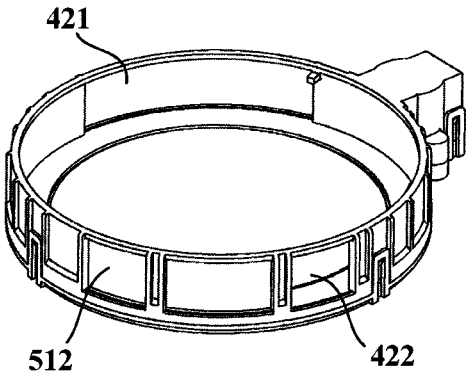
Figure 6:
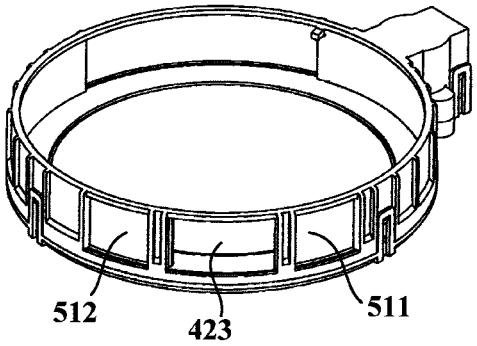
Figure 7:
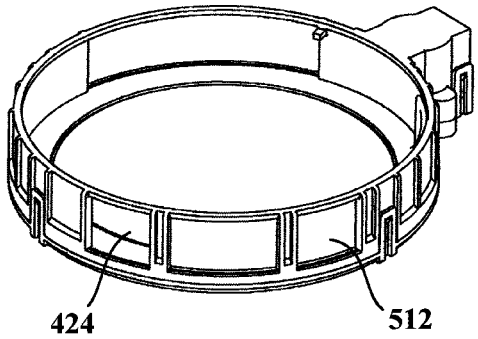

FIG. 3 is a schematic exploded view of the branched air supply device 300 of a refrigerator according to an embodiment of the present invention. As shown in FIG. 3, the housing 40 of the branched air supply device 300 may comprise a base 41 and a circumferential wall 42. The circumferential wall 42 may extend from the base 41 to a side of the base 41. Moreover, the plurality of air outlets are formed on the circumferential wall 42. For example, a circumferential edge of the base 41 preferably comprises an arc-shaped first edge section and second edge section. The circumferential wall 42 may have a first section that is of the circumferential wall 42 and extends from the first edge section to a side of the base 41. The plurality of air outlets may be formed on the first section of the circumferential wall 42. In some embodiments, the first section of the circumferential wall 42 is a complete arc-shaped section of the circumferential wall 42. The plurality of air outlets are provided on the first section of the circumferential wall 42. Each air outlet may have an opening edge. In some other embodiments, the first section of the circumferential wall 42 may comprise at least three arc-shaped section portions of the circumferential wall 42 and an interval located between two arc-shaped section portions of the circumferential wall 42. An interval between every two arc-shaped section portions of the circumferential wall 42 is one air outlet. The arc-shaped section portions of the circumferential wall 42 can be processed to only extend out from a plurality of positions of the first edge section of the base 41 to a side of the base 41.

In still some other embodiments of the present invention, the housing 40 further comprises a distributor cover 43, covering an end, far away from the base 41, of the circumferential wall 42, so that the distributor cover, the base 41, and the circumferential wall 42 define a duct space, that is, an internal space of the housing 40. To facilitate the mounting of the distributor cover 43, the housing 40 may further comprise a plurality of clamping arms 44 that extend respectively from a plurality of positions on an edge of the distributor cover 43 towards the base 41. A clamping groove or bump is formed on an inner surface of each clamping arm 44. A plurality of bumps that respectively fit the clamping grooves or a plurality of clamping grooves that respectively fit the bumps are formed on an outer surface of the circumferential wall 42, to enable the distributor cover 43 to be clamped at the base 41.

In some embodiments of the present invention, the at least one air inlet 421 is further formed on the circumferential wall 42, and the at least one air inlet 421 is provided between two adjacent air outlets. Specifically, in some embodiments, one air inlet 421 is provided (in other words, the quantity of the air inlets 421 is one), and two ends of the first section of the circumferential wall 42 in a circumferential direction of the base 41 define the air inlet 421. In some other embodiments, the circumferential wall 42 may further comprise a second section of the circumferential wall 42 extending from the second edge section of the base 41 to a side of the base 41. The second edge section is also preferably designed to have an arc shape that is concentric with the first edge section, so that the first section of the circumferential wall 42 and the second section of the circumferential wall 42 are located on the same cylindrical circumferential wall 42. That is, the first section of the circumferential wall 42 and the second section of the circumferential wall 42 are coaxial. The at least one air inlet 421 is formed on the second section of the circumferential wall 42.

In some alternative embodiments of the present invention, the circumferential wall 42 may further comprise the second section of the circumferential wall 42 extending from the second edge section of the base 41 to a side of the base 41. The at least one air inlet 421 may be provided on the distributor cover 43. In the embodiments, the branched air supply device 300 may further comprise an air supply device configured to drive cold air to flow into the housing 40 from the at least one air inlet 421 and flow out from the housing 40 through the one or more of the plurality of air outlets, so that the air supply efficiency can be significantly improved. For example, the air supply device is a centrifugal impeller and is disposed in the housing 40.

In some embodiments of the present invention, the adjustment member 50 may comprise one or more blocking portions 51 disposed at an interval in the circumferential direction of the base 41. The adjustment member 50 may be rotatably mounted on the housing 40 about an axis of the circumferential wall 42, so that when rotating to different rotational positions, the adjustment member 50 enables the one or more blocking portions 51 to completely block, partially block or completely expose each air outlet. Specifically, at least a part of a surface, facing the circumferential wall 42, of each blocking portion 51 is disposed coaxially with the first section of the circumferential wall 42. For example, each blocking portion 51 may be an arc-shaped blocking plate, to block or expose each air outlet. The blocking portion 51 of the adjustment member 50 may be mounted in the housing 40 or may be mounted outside the housing 40.

If the blocking portion 51 of the adjustment member 50 is mounted in the housing 40 and when the adjustment member 50 rotates about the axis of the circumferential wall 42, in some embodiments, an outer side surface of the arc-shaped blocking plate may stay attached on an inner side surface of the first section of the circumferential wall 42 in a sealed manner In this way, at different rotational positions, the arc-shaped blocking plate can open or close one or more air outlets in a controlled manner In some other embodiments, to facilitate the rotation of the adjustment member 50, a distance between each blocking portion 51 and the circumferential wall 42 may be slightly increased. However, if the distance between the blocking portion 51 and the circumferential wall 42 is increased, air may leak and completely effective blocking cannot be implemented. Cold air may flow from one air outlet to another air outlet through a gap between the circumferential wall 42 and the blocking portion 51. Therefore, the branched air supply device 300 in the embodiments of the present invention may further comprise a sealing device, configured to at least partially prevent cold air from flowing to each air outlet through a gap between an outer surface of each blocking portion 51 and an inner surface of the circumferential wall 42. Specifically, the sealing device may comprise at least two sealing gaskets. Each sealing gasket extends in a direction parallel to a rotational axis of the adjustment member 50. One sealing gasket is respectively provided at two ends of the arc-shaped outer surface of each blocking portion 51 in a rotational direction of the blocking portion 51.

In some embodiments of the present invention, as shown in FIG. 3, the adjustment member 50 may further comprise a turntable portion 52 disposed coaxially with the circumferential wall 42, and each blocking portion 51 extends out from one surface from the turntable portion 52. The turntable portion 52 may have a disc form or a ring form. The full-circumferential structure may make the movement of the adjustment member 50 more stable. In some other embodiments, the turntable portion 52 may alternatively have another shape such as a fan shape.

In some embodiments of the present invention, the branched air supply device 300 may further comprise a motor 60 and a transmission mechanism. The motor 60 may be disposed on a radial outer side of the turntable portion 52.

The transmission mechanism is configured to transfer a rotational movement output by the motor 60 to the adjustment member 50 at a reduced speed. During designing, the inventors find that the rotation of the adjustment member 50 is not stable enough, and the reason is the vibration of the motor 60. Therefore, the inventors propose to use the transmission mechanism to alleviate the impact of the vibration of an output shaft of the motor 60, to enable the adjustment member 50 to turn precisely. The functions of reducing a speed and increasing a torque of the transmission mechanism can further eliminate a jamming and stalling phenomenon of the motor 60. The motor 60 is disposed at a special position, so that the overall thickness of the branched air supply device 300 can be reduced, the space is saved, and the branched air supply device is particularly applicable to the refrigerator.

In some embodiments of the present invention, the transmission mechanism is preferably a transmission mechanism of a gear 71. Specifically, the transmission mechanism may comprise the gear 71 and a gear ring 72 engaged with the gear 71. The gear 71 may be mounted on the output shaft of the motor 60. The gear ring 72 may be integrated with the turntable portion 52 or exists independently and is fixed at the turntable portion 52. For example, the gear ring 72 comprises an annular convex rib that extends out from the other surface of the turntable portion 52 and is coaxial with the turntable portion 52 and a plurality of gear teeth that extend externally out from an outer circumferential surface of the annular convex rib and are disposed at an interval in a circumferential direction of the annular convex rib. Alternatively, the gear ring 72 is independent, and is fixed on the other surface of the turntable portion 52 coaxially with the turntable portion 52.

Further, in some embodiments, as shown in FIG. 3, the turntable portion 52 has a ring form and may be mounted at the end, far away from the base 41, of the circumferential wall 42. When the at least one air inlet 421 is further formed on the circumferential wall 42, the turntable portion 52 may also have a plate form and may have the effect of closing an opening at an end portion of the circumferential wall 42.

An annular groove 431 may be formed on an inner surface of the distributor cover 43, and the gear ring 72 is mounted in the annular groove 431, so that the adjustment member 50 can move stably. Preferably, the turntable portion 52 may have a ring form. The annular groove 431 may be a stepped groove and is further configured to accommodate the turntable portion 52, so that the movement stability of the adjustment member 50 can further be ensured. To protect the motor 60, the housing 40 further comprises an accommodating portion for the motor 60. The accommodating portion is provided on the outer surface of the circumferential wall 42. An accommodating cavity for accommodating the gear 71 and the motor 60 is defined in the accommodating portion. In some other embodiments, the turntable portion 52 may be mounted on an inner surface of the base 41.

In some embodiments of the present invention, if the at least one air inlet 421 is formed on the circumferential wall 42, the adjustment member 50 is further configured to enable, when rotating to a rotational position, the one or more blocking portions 51 to completely block the at least one air inlet 421, to disconnect the air supply duct 221.

In some embodiments of the present invention, the plurality of air outlets of the branched air supply device are grouped into at least two groups, and each group of air outlets has at least one air outlet. The air outlets in each group of air outlets have an equal size. The size of each air outlet in each group of air outlets is unequal to the size of each air outlet in each of the rest groups of air outlets. For example, three air outlets are provided and are respectively a first air outlet 422, a second air outlet 423, and a third air outlet 424. The first air outlet 422 and the third air outlet 424 have an equal size and are in a group. The size of the second air outlet 423 may be 1.2 to 2 times the size of the first air outlet 422, and is separately in a group.

In some embodiments of the present invention, air supply ports are provided on duct walls on both sides of the air supply duct 221. An air outlet located on a side of a central dividing plane of the air supply duct 221 preferably transfers cold air flowing out from the air outlet on the side to an air supply port located on the side of the central dividing plane of the air supply duct 221. Because the air outlet located on the side of the central dividing plane of the air supply duct 221 preferably transfers cold air flowing out from the air outlet to a duct wall, the cold air flows forward along the duct wall, and preferably flows out from the air supply duct 221 from the air supply port on the duct wall on the side. The air outlet located in the middle portion may transfer cold air to a relatively far position, to enable the cold air to enter the storage compartment 211 from an air supply port in a position at an end portion of the air supply duct 221.

For example, three air outlets are provided and are respectively a first air outlet 422, a second air outlet 423, and a third air outlet 424. The first air outlet 422 and the third air outlet 424 are provided on two sides of the second air outlet 423. A first air supply port 222 is provided on a duct wall, close to the first air outlet 422, of the air supply duct 221, and is configured to transfer cold air into the middle portion or the lower portion of the storage compartment 211. A second air supply port 223 is provided at the end portion of the air supply duct 221, and is configured to transfer cold air into the upper portion of a storage space. A third air supply port 224 is provided on a duct wall, close to the third air outlet 424, of the air supply duct 221, and is configured to transfer cold air into the middle portion of the storage compartment 211. When the first air outlet 422 is in an opened state, the amount of cold air that enters the first air supply port 222 may account for 65% to 75% of cold air flowing out from the first air outlet 422. When the second air outlet 423 is in an opened state, the amount of cold air that enters the first air supply port 222 may account for 55% to 65% of cold air flowing out from the second air outlet 423. When the third air outlet 424 is in an opened state, the amount of cold air that enters the first air supply port 222 may account for 50% to 60% of cold air flowing out from the second air outlet 423. By using such a setting, the refrigerator can enable the branched air supply device 300 to open corresponding air outlets according to cold demands at different heights of the storage compartment 211. Optionally, the storage compartment 211 may be divided by a storage tray/storage shelf 230 into a plurality of storage spaces, for example, four storage spaces. The second air outlet 423 may transfer cold air into the uppermost storage space. The first air outlet 422 may transfer cold air into a storage space above the lowermost storage space. The second air outlet 423 may transfer cold air into a storage space below the uppermost storage space.

In some embodiments of the present invention, as shown in FIG. 1, one air inlet 421 is provided on the circumferential wall 42. Three air outlets are provided sequentially at an interval on the circumferential wall 42 in the circumferential direction of the base 41. The three air outlets are respectively the first air outlet 422, the second air outlet 423, and the third air outlet 424, which may be provided sequentially at an interval in the circumferential direction of the base 41 and in the counterclockwise direction (in the clockwise direction of the distributor cover 43). Two blocking portions 51 are provided. The two blocking portions 51 are respectively a first blocking portion 511 and a second blocking portion 512, which may be disposed sequentially at an interval in a circumferential direction of the turntable portion 52 and in the counterclockwise direction (in the clockwise direction of the distributor cover 43). The first blocking portion 511 may be configured in a way that the first blocking portion is allowed to completely block one air outlet. The second blocking portion 512 may be configured in a way that the second blocking portion is allowed to completely block two air outlets and the second blocking portion is allowed to completely block the air inlet 421 of the housing 40. An interval between the first blocking portion 511 and the second blocking portion 512 may be configured in a way that the interval is allowed to completely expose one air outlet.

FIGS. 4 to 11 are respectively schematic partial structural diagrams of an adjustment member 50 in a branched air supply device 300 of a refrigerator at different rotational positions according to embodiments of the present invention. When the first blocking portion 511 and the second blocking portion 512 rotate to the positions shown in FIG. 4, the first air outlet 422, the second air outlet 423, and the third air outlet 424 are all in an opened state. When the first blocking portion 511 and the second blocking portion 512 rotate to the positions shown in FIG. 5, the second blocking portion 512 may completely block the second air outlet 423 and the third air outlet 424. The interval between the two blocking portions 51 may keep the first air outlet 422 in a completely exposed state. When the first blocking portion 511 and the second blocking portion 512 rotate to the positions shown in FIG. 6, the first blocking portion 511 may completely block the first air outlet 422, the second blocking portion 512 may completely block the third air outlet 424, and the interval between the two blocking portions 51 may keep the second air outlet 423 in a completely exposed state. When the first blocking portion 511 and the second blocking portion 512 rotate to the positions shown in FIG. 7, the second blocking portion 512 completely blocks the first air outlet 422 and the second air outlet 423, and the third air outlet 424 may be kept in a completely exposed state.

Figure 8:
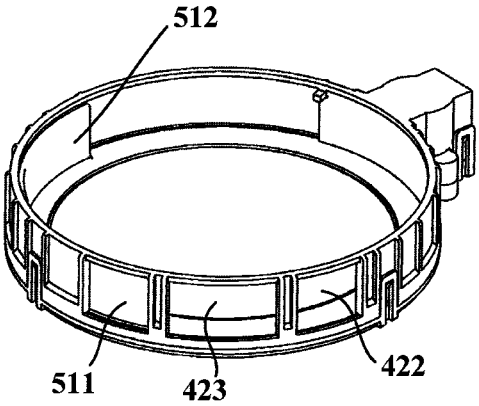
Figure 9:
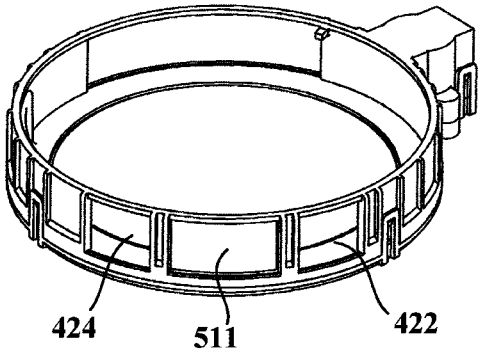
Figure 10:
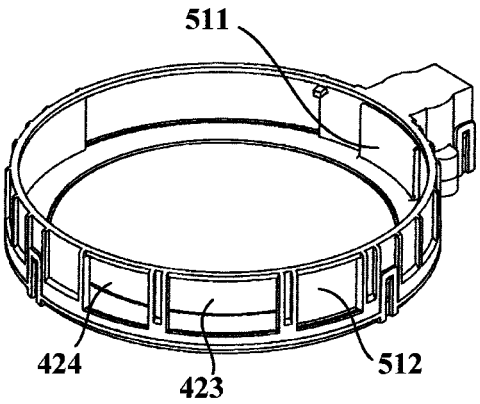
Figure 11:
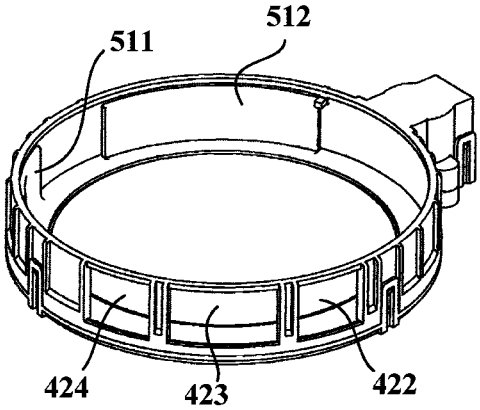

When the first blocking portion 511 and the second blocking portion 512 rotate to the positions shown in FIG. 8, the first blocking portion 511 may completely block the third air outlet 424, and the first air outlet 422 and the second air outlet 423 are in a completely exposed state. When the first blocking portion 511 and the second blocking portion 512 rotate to the positions shown in FIG. 9, the first blocking portion 511 may completely block the second air outlet 423, the first air outlet 422 is in a completely exposed state, and the interval between the two blocking portions 51 may keep the third air outlet 424 in a completely exposed state. When the first blocking portion 511 and the second blocking portion 512 rotate to the positions shown in FIG. 10, the second blocking portion 512 may only completely block the first air outlet 422, and the second air outlet 423 and the third air outlet 424 are in a completely exposed state. When the first blocking portion 511 and the second blocking portion 512 rotate to the positions shown in FIG. 11, the second blocking portion 512 may completely block the air inlet 421, to keep the air supply duct 221 in a closed state.

Certainly, the first blocking portion 511 and the second blocking portion 512 may alternatively rotate to rotational positions to block a half of the third air outlet 424 and keep the first air outlet 422 and the second air outlet 423 in a completely exposed state. For example, the first blocking portion 511 is in a position of only blocking a half, far away from the second air outlet 423, of the third air outlet 424. The first blocking portion 511 and the second blocking portion 512 may alternatively rotate to rotational positions of completely blocking the third air outlet 424, blocking a half of the second air outlet 423, and keeping the first air outlet 422 in a completely exposed state. For example, the second blocking portion 512 is in a position of completely blocking the third air outlet 424 and blocking a half, far away from the first air outlet 422, of the second air outlet 423.

Up to this, a person skilled in the art should recognize that although a plurality of exemplary embodiments of the present invention have been shown and described in detail herein, numerous other variations or modifications meeting the principle of the present invention can be directly determined or derived according to the contents disclosed in the present invention. Therefore, the scope of the present invention should be construed and considered as covering all of such other variations or modifications.

What is claimed is:

1. A refrigerator, comprising:

a main body, a storage compartment and an air supply duct being defined in the main body, and the air supply duct being configured to transfer cold air into the storage compartment; and a branched air supply device, disposed in the air supply duct, and the branched air supply device comprising:

a housing, having at least one air inlet and a plurality of air outlets; and an adjustment member, configured to completely block, partially block or completely expose each air outlet in a controlled manner, to adjust respective air outlet areas of the plurality of air outlets, so as to adjust the amount of air transferred into the storage compartment through the air supply duct, wherein the housing comprises a base and a circumferential wall extending from a side of the base to an outside of the base, and the plurality of air outlets are formed on the circumferential wall;

the adjustment member comprises one or more blocking portions which are arc-shaped blocking plates disposed at an interval in a circumferential direction of the base and in parallel with and in contact with the circumferential wall, and the adjustment member is rotatably mounted on the housing about an axis of the circumferential wall, so that when rotating to different rotational positions, the adjustment member enables the one or more blocking portions to completely block, partially block or completely expose each air outlet, wherein the housing further comprises a distributor cover, covering an end, facing away from the base, of the circumferential wall;

an annular groove is formed on an inner surface of the distributor cover, and a gear ring is mounted in the annular groove to stably move the adjustment member, the adjustment member further comprises a turntable portion disposed coaxially with the circumferential wall, and each blocking portion extends out from one surface from the turntable portion, and a turntable portion is in a ring form, and the annular groove is a stepped groove and is further configured to accommodate the turntable portion.

2. The refrigerator according to claim 1, wherein the air supply duct has at least one air supply port, and each of the air outlets is connected to any one of the at least one air supply port, to enable cold air flowing from the air outlets to enter the storage compartment through each air supply port.

3. The refrigerator according to claim 1, wherein the plurality of air outlets are grouped into at least two groups, and each group of air outlets has at least one air outlet;

the air outlets in each group of air outlets have an equal size; and the size of each air outlet in each group of air outlets is unequal to the size of each air outlet in each of any rest groups of air outlets.

4. The refrigerator according to claim 1, wherein at least another one air inlet is further formed on the circumferential wall, and the at least another one air inlet is provided between two adjacent air outlets.

5. The refrigerator according to claim 4, wherein the adjustment member is further configured to enable, when rotating to a rotational position, the one or more blocking portions to completely block the at least another one air inlet, to disconnect the air supply duct.

6. The refrigerator according to claim 5, wherein one air inlet is provided;

three air outlets are provided sequentially at an interval in the circumferential direction of the base;

two blocking portions are provided, the two blocking portions are respectively a first blocking portion and a second blocking portion;

the first blocking portion is configured in a way that the first blocking portion is capable of completely blocking one air outlet;

the second blocking portion is configured in a way that the second blocking portion is capable of completely blocking two air outlets and the second blocking portion is capable of completely blocking the air inlet; and an interval between the first blocking portion and the second blocking portion is configured in a way that the interval is capable of completely exposing one air outlet.

7. The refrigerator according to claim 1, wherein the branched air supply device further comprises:

a motor, disposed on a radial outer side of the turntable portion; and a gear, mounted on an output shaft of the motor;

wherein the gear ring comprises an annular convex rib that extends out from an other surface of the turntable portion and is coaxial with the turntable portion and a plurality of gear teeth that extend externally out from an outer circumferential surface of the annular convex rib and are disposed at an interval in a circumferential direction of the annular convex rib, where the gear is engaged with the gear ring, to transfer a rotational movement output by the motor to the adjustment member at a reduced speed.

* * * * *